United States Patent [19]

Marxer

[11] Patent Number: 4,761,899

[45] Date of Patent: Aug. 9, 1988

[54] SKI BOOT

[75] Inventor: Herbert Marxer, Schaan, Liechtenstein

[73] Assignee: Lange International S.A., Fribourg, Switzerland

[21] Appl. No.: 44,348

[22] Filed: Apr. 30, 1987

[30] Foreign Application Priority Data

Jun. 6, 1986 [CH] Switzerland ..... 2305/86

[51] Int. Cl.[4] ..... A43B 5/04

[52] U.S. Cl. ..... 36/121; 36/50; 36/105

[58] Field of Search ..... 36/117–121, 36/50, 105; 24/68 SK, 69 SK, 70 SK, 71 SK

[56] References Cited

U.S. PATENT DOCUMENTS 4,519,150 5/1985 Arieh et al. ..... 36/121
4,575,958 3/1986 Arieh et al. ..... 36/121
4,677,771 7/1987 Arieh et al. ..... 36/120

FOREIGN PATENT DOCUMENTS 0149445 7/1985 European Pat. Off. ..... 36/121
2404447 8/1974 Fed. Rep. of Germany ..... 36/121

*Primary Examiner*—James K. Chi
*Attorney, Agent, or Firm*—Kane, Dalsimer, Sullivan, Kurucz, Levy, Eisele and Richard

[57] ABSTRACT

The boot comprises an upper (4) hinged (5) with a shell (1). A mechanism allows the upper to be locked to the shell or to be pivoted. This mechanism consists of two links (7, 8) hinged with each other and, on the one hand, with the shell (10) and, on the other hand, with the upper (11). The pin (9) hingeably connecting the links together is accommodated, on the one hand, inside a notch (**19*b*) in the top link (8) and, on the other hand, in a fixed oblong aperture (16). The notch (19*b*) leads into an oblong aperture (19*a*) in the top link (8). The mechanism is kept in this locked position by a spring (26). A lever (27) enables the oblong aperture (19*a*) to be brought opposite the hinging point (9) so that this pin is able to slide inside the superimposed apertures (16, 19*a***).

5 Claims, 3 Drawing Sheets

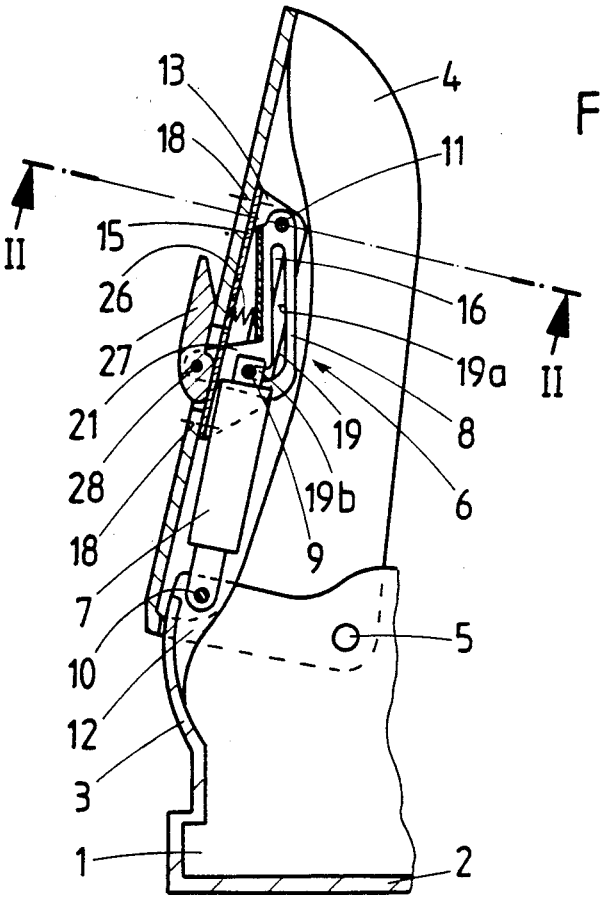
Fig. 1
Fig. 2
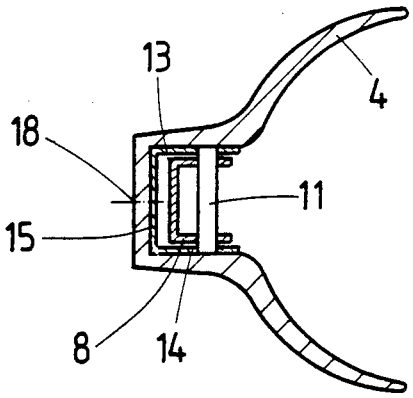

11
15
23
24
17
14
28
25
8
19b
20a
26
20
27
21
19
22
20b
27a
33
32
7
9
10
29
34
30

SKI BOOT

FIELD OF THE INVENTION

The present invention relates to a ski boot made of at least semi-rigid material and consisting of a bottom part comprising the sole and surrounding the foot and the heel and of an upper hinged with the bottom part and comprising, at the rear, a mechanism connecting the upper and the bottom part, this mechanism comprising essentially two links hinged with each other and with the upper and the bottom part, respectively, the mechanism being arranged in such a way that it is able to assume a first position where the upper is locked relative to the bottom part and a second position where the upper is free to pivot on the bottom part, one of the links being provided with manual operating means.

PRIOR ART

A boot comprising such a connecting mechanism is described in the U.S. Pat. No. 4,349,971. In this boot, the links form a knuckle joint. In order to change over from the position where the mechanism is released and open to the position where it is closed, or vice versa, the skier must directly operate one of the links and in each case must overcome the resistance of the boot itself in order to pass beyond the neutral position of the knuckle joint, ie. beyond the position where its three hinging points are aligned. When the knuckle joint is closed, the skier must also often overcome the resistance of the ankle itself, if the latter is not flexed. Moreover, when the upper of the boot pivots during walking, the hinging points of the knuckle joint are continuously stressed. These hinging points are usually in a position such that the knuckle joint offers a not inconsiderable resistance to rotation of the boot upper towards the rear.

Furthermore, a boot is known, which is equipped with a device for locking the upper, consisting of a rocker cooperating with a stop (U.S. Pat. No. 4,349,971). This device has the advantage that it automatically locks under the action of a spring when the skier flexes his leg. However, this locking action may occur unexpectedly in the rest or walking position.

SUMMARY OF THE INVENTION

The aim of the present invention is to provide a mechanism for connecting the upper and the bottom part of the boot, which can be easily unlocked, which locks automatically when the leg is flexed, and the resistance of which is almost zero in the walking position.

For this purpose, in the ski boot according to the invention one of the links has an aperture or groove inside which the pin hingeably connecting the links together is engaged, this aperture or groove having a longitudinal part and a transverse part at the opposite end to the point where it is hinged with the boot, an elastic means acting transversely on the link hinged with the upper and tending to keep the pin hingeably connecting the links together inside the bottom of the transverse part of the aperture or groove, the said manual operating means being arranged so as to move the links angularly relative to each other so as to disengage the hinging pin from the transverse part of the said aperture or groove so that this pin is able to slide in the longitudinal part of the aperture or groove.

The only resistance to be overcome in order to unlock the connecting mechanism is that of the elastic means. This elastic means has only a positioning function and is relatively weak. During a walking movement, the pin hingeably connecting the links together moves freely inside the aperture, so that the resistance of the mechanism is practically zero. The elastic means ensures, moreover, automatic locking of the connecting mechanism when the skier flexes his leg.

The connecting mechanism may, moreover, be easily provided with a member for keeping it in the unlocked position so as to prevent unwanted automatic locking of the mechanism.

Unlocking of the connecting mechanism may be achieved by means of pressure or a pulling force, the second solution being preferable in order to avoid unlocking due to an external knock.

The link hinged with the upper may be either the link provided with the aperture or groove or the other link.

The link which is not provided with an aperture may be elastically extendable so as to ensure that the upper has a certain degree of elasticity during flexion.

BRIEF DESCRIPTION OF THE DRAWINGS

The accompanying drawings show, by way of an example, an embodiment of the invention.

FIG. 1 is a partial cross-sectional view of a ski boot, showing the rear part of this boot in its working position during skiing.

FIG. 2 is a section along the line II—II of FIG. 1.

DESCRIPTION OF THE PREFERRED EMBODIMENT

Figure 3:
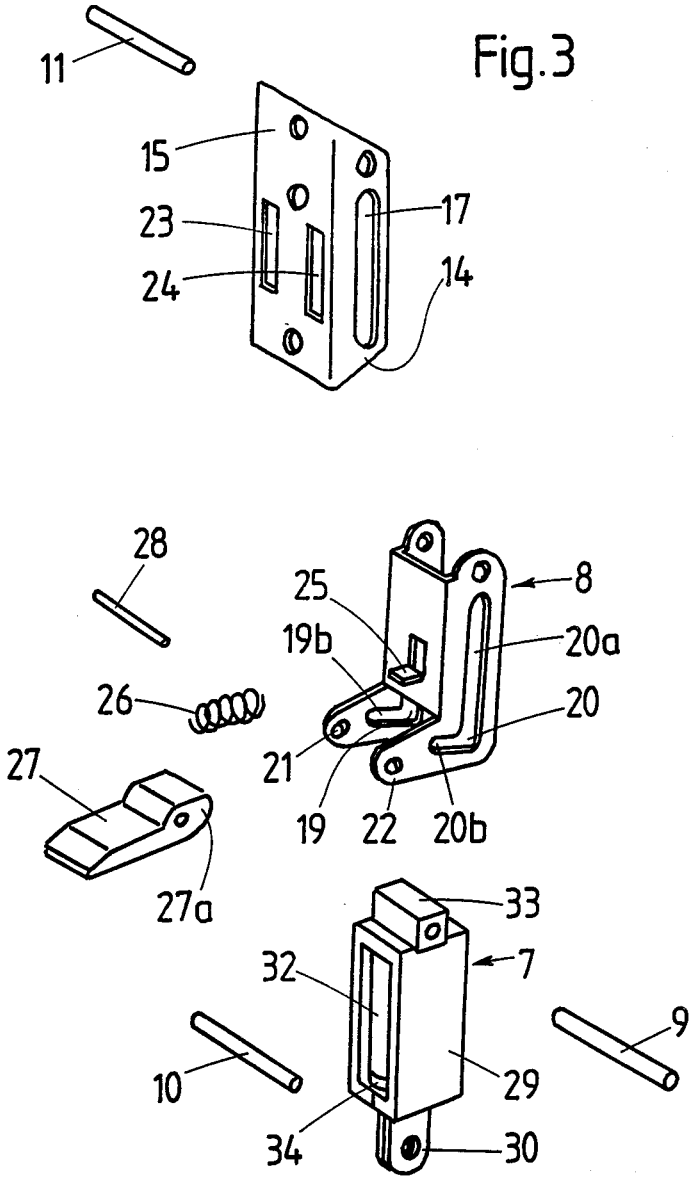
FIG. 3 is an exploded view of the connecting mechanism shown in FIG. 1.
Figure 4:
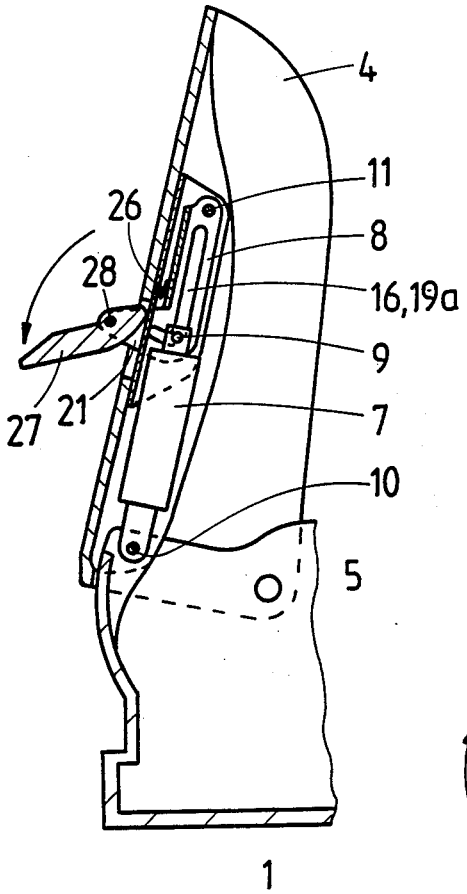
FIG. 4 is a view similar to that of FIG. 1, showing the connecting mechanism in the rest or walking position.

The boot partially shown in the drawing consists of a bottom shell 1 comprising the sole 2 and surrounding the foot and the heel 3. On this shell there is hingeably mounted an upper consisting of two parts, ie. a front part (not shown) and a rear part 4 which is hinged with the shell 1 at 5. As can be seen in FIG. 4, this rear part is able to pivot relatively far backwards owing to the special shape of the shell in the region of the heel. The boot shown is of the so-called rear-fitting type. The front part of the upper may be hinged about the same pin 5, which corresponds as closely as possible to the heel joint, or about another pin. The upper could also consist of a single piece.

The boot shown has, at the rear, a mechanism 6 for connecting the bottom shell and the upper 4. This connecting mechanism consists essentially of two links 7 and 8 which are hingeably connected together via a pin 9, the link 7 being moreover hinged with the shell via a pin 10 and the link 8 being hinged with the upper via a pin 11. The pin 10 is mounted between two internal ribs 12 provided on the shell 1. These ribs 12 also serve to limit, by means of their profile, the internal volume of the shell intended to receive the heel of the skier. As for the pin 11 hinging the top link 8 with the upper, it is mounted between the two parallel flanges 13 and 14 (FIG. 2) of a metal support piece 15 consisting of a U-shaped section inserted in a recess having the same profile and formed in the rear part 4 of the upper, as shown in FIG. 2, the support piece 15 being fixed to the bottom of this recess by means of two rivets 18, the axes of which are indicated. The flanges 13 and 14 of the support piece 15 have, moreover, two identical and opposite longitudinal grooves 16 and 17 inside which the ends of the pin 9 hingeably connecting the links together are guided.

The top link 8 also consists of a metal piece with a U-shaped profile (FIG. 2). This link 8 is hinged between the flanges 13 and 14 of the support piece 15 and its flanges are provided with two opposite and identical apertures 19 and 20, each of these apertures having a longitudinal part **19*a* and 20*a*, respectively, and a transverse part 19*b* and 20*b*, respectively, forming an angle of slightly less than 90° with the longitudinal part. These transverse parts 19*b* and 20*b* form locking notches, as will be described below. The link 8 is provided, moreover, with two bent arms 21 and 22, which pass through the support piece 15 via two apertures 23 and 24, and a small lug 25 acting as a support and guide for a helical spring 26 which is compressed between the link 8 and the support piece 15. A cam lever 27 is hinged between the ends of the arms 21 and 22 by means of a pin 28. The bottom link 7 consists of a rectangular cage 29 which is formed by cutting and folding means and the ends of which are pressed together so as to form a small lug 30 by means of which the link is hinged with the shell, and of a pin 31 passing through an elastomer cylinder 32, this pin being provided, at one end, with a head 33 receiving the hinging pin 9 and at its other with a washer 34, the elastomer cylinder 32 being of such a length that, when it is not compressed or only slightly compressed between the washer 34 and the top of the cage 29, the head 33 bears against the end of the cage 29. The link 7** is therefore elastically extendable, but cannot be compressed. The connecting mechanism described above operates as follows:

In the skiing position shown in FIG. 1, the cam lever 27 is pressed against the upper 4 and the spring 26 keeps the link 8 at a distance from the support piece 15. The pin 9 hingeably connecting the links together, which is retained laterally by the guiding grooves 16 and 17, is at the bottom of the locking notches **19*b* and 20*b*. The upper 4 is consequently locked in the position shown in FIG. 1. However, because of the elasticity of the link 7**, the boot upper is able to bend forwards slightly, with a degree of elasticity, so as to ensure comfort and safety for the skier.

Figure 5:
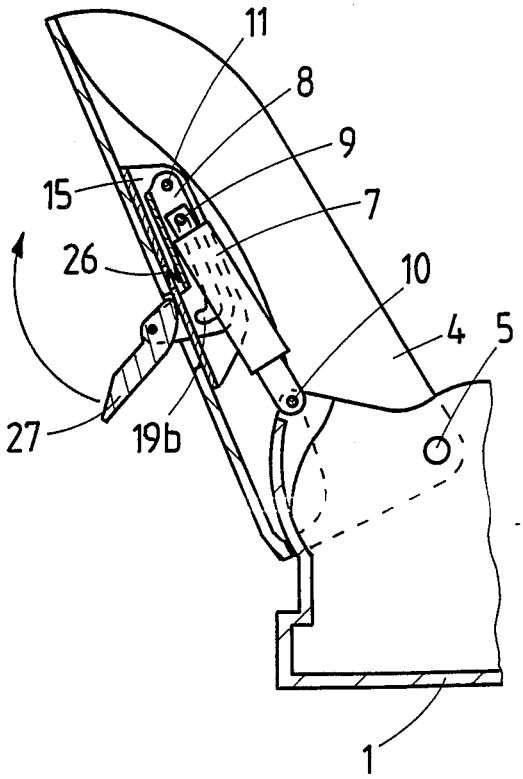
FIG. 5 is a view similar to the views of FIGS. 1 and 4, showing the boot in the position allowing the foot to be inserted.
Figure 6:
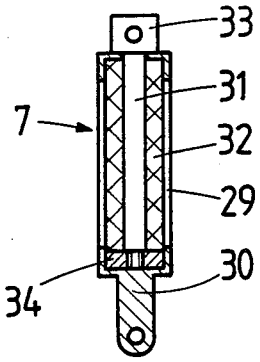
FIG. 6 is a cross-section of the bottom link which is elastically extendable.

In order to change to the rest or walking position, the cam lever 27 is pivoted downwards, as shown in FIG. 4. The cam part **27*a* of this cam lever bears against the support piece 15 and has the effect of exerting a pulling force on the arms 21 and 22 of the link 8 which positions itself substantially parallel to the support piece 15, compressing the spring 26 such that the longitudinal parts 19*a* and 20*a* of the apertures in the link 8 coincide with the guiding grooves 16 and 17 of the support piece 15. The pin 9 is thus able to slide inside the guides 16 and 17 and the upper 4 is able to pivot freely about its hinging point 5, the cam lever remaining in the position shown in FIG. 5. In order to put on the boot, the rear part of the upper 4, or the upper 4, is tilted backwards, the length of the guiding grooves and apertures being sufficient to allow a maximum tilting action. The cam lever 27 is then pressed back against the upper 4, into the position shown in FIG. 1. The cam lever 27 may also be pressed back when the upper is in the position shown in FIG. 4, the link 8 being angularly retained by the pin 9. When the leg is flexed a first time, the pin 9 is positioned opposite the locking notches 19*b* and 20*b* and the spring 26 is thus able to bring the link 8 automatically back into the locked position shown in FIG. 1**.

The extendable link 7 could, of course, be replaced by a rigid link if the elastic deformation of the boot is sufficient to ensure its elasticity during flexion.

According to another variation of the embodiment, the locking notches could be oriented towards the inside of the boot; the spring 26 would then be arranged on the other side of the link 8. In this case, unlocking of the connecting mechanism would be effected by means of pressure on the link 8, either by means of a cam which would keep the link 8 in the unlocked position or without a cam, although this would have the drawback that the mechanism could involuntarily become unlocked when the leg is flexed.

According to another variation, the links 7 and 8 could be reversed, the extendable link 7 thus being hinged with the upper 4 of the boot. In this case, unlocking could also be effected either by means of a pulling force or by means of pressure on the top link, depending on the orientation of the locking notches.

I claim:

1. Ski boot made of at least semi-rigid material and consisting of a bottom part (1) comprising the sole and surrounding the foot and the heel and of an upper (4) hinged with the bottom part and comprising a connecting mechanism (6) comprising essentially two links (7, 8) hinged with each other and with the upper and the bottom part of the boot, respectively, the mechanism (6) being arranged in such a way that it is able to assume a first position where the upper is locked relative to the bottom part and a second position where the upper is free to pivot on the bottom part, one of the links being provided with manual operating means, wherein the other link has an aperture (19) inside which the pin (9) hingeably connecting the links together is engaged, this aperture or groove having a longitudinal part (**19*a*) and a transverse part (19*b* at the opposite end of the pin (11) where it is hinged with the boot, the connecting mechanism comprising in addition an elastic means (26) acting transversely on the link hinged with the upper and tending to keep the pin (9) hingeably connecting the links together inside the bottom of the transverse part (19*b*) of the aperture or groove, the said manual operating means (27) being arranged in such a way as to move the links angularly relative to each other so as to disengage the hinging pin (9**) from the transverse part of the said aperture or groove, in such a way that this pin is able to slide inside the longitudinal part of the aperture.

2. Boot as claimed in claim 1, wherein the other link (7) is elastically extendable.

3. Boot as claimed in claim 2, wherein the extendable link (7) consists of a cage (29) and a pin (31) provided with a washer (34) retained inside the cage by an elastomer body (32).

4. Boot as claimed in one of claims 1 to 3, wherein the transverse part (**19*b*) of the aperture or groove is directed towards the outside of the boot and forms an angle of less than 90° with the longitudinal part (19*a*), wherein the said elastic means (26) is compressed between the link (8) hinged with the upper and the upper, and wherein the said manual operating means consist of a cam lever (27) hinged with the external lateral end of the link (8) hinged with the upper, a cam part of this cam lever bearing against the upper so as to compress the elastic means and bring the longitudinal part of the aperture opposite the pin hingeably connecting the link and comprising guiding means (16,17) being provided for preventing rotation of the other link (7**) during this movement.

5. Boot as claimed in claim 4, in which the link provided with the aperture or groove is the link hinged with the upper, wherein the link (8) hinged with the upper is hinged by means of a pin (11) mounted between the two flanges (13, 14) of a U-shaped metal support piece (15) fixed to the upper and serving as a bearing surface for the said elastic means (26) and the said cam lever (27), the flanges of this U-shaped piece having opposite and parallel said guiding means (16, 17) inside which the pin (9) hingeably connecting the links together is engaged, these grooves coinciding with the longitudinal part (**19*a*, 20*a***) of the aperture of the link when this part of the aperture is brought opposite the pin hingeably connecting the links together.

* * * * *